US007256372B2

(12) United States Patent
Knoeppel et al.

(10) Patent No.: US 7,256,372 B2
(45) Date of Patent: Aug. 14, 2007

(54) FLUID-HEATING APPARATUS, CIRCUIT FOR HEATING A FLUID, AND METHOD OF OPERATING THE SAME

(75) Inventors: Ray O. Knoeppel, Hartland, WI (US); Thomas G. Van Sistine, Menomonee Falls, WI (US); Jason W. T. Scott, Elkhorn, WI (US); David E. Morris, Racine, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 11/296,745

(22) Filed: Dec. 7, 2005

(65) Prior Publication Data

US 2007/0125764 A1 Jun. 7, 2007

(51) Int. Cl.
*H05B 1/02* (2006.01)

(52) U.S. Cl. ..... 219/497; 219/486; 219/485; 219/507; 307/39; 361/54

(58) Field of Classification Search ..... 219/483–487, 219/501, 481, 497, 499, 494, 412–414, 505, 219/507, 508; 307/39–42; 361/54–58
See application file for complete search history.

(56) References Cited

U.S. PATENT DOCUMENTS

| | | | | |
|---|---|---|---|---|
| 4,103,319 | A | 7/1978 | Crain et al. | |
| 4,520,417 | A | 5/1985 | Frank | |
| 5,039,842 | A | 8/1991 | Kochajda | |
| 5,710,408 | A | 1/1998 | Jones | |
| 5,973,896 | A | 10/1999 | Hirsh et al. | |
| 6,080,973 | A | 6/2000 | Thweatt, Jr. | |
| 6,112,013 | A | 8/2000 | Hsiao et al. | |
| 6,218,647 | B1 | 4/2001 | Jones | |
| 6,646,237 | B2 | 11/2003 | Liu | |
| 6,730,884 | B2 | 5/2004 | Baker et al. | |
| 2001/0020615 | A1 * | 9/2001 | Bradenbaugh | 219/497 |
| 2004/0161227 | A1 | 8/2004 | Baxter | |
| 2006/0013573 | A1 | 1/2006 | Phillips | |

OTHER PUBLICATIONS

Ray O. Knoeppel et al., U.S. Appl. No. 11/296,053, filed Dec. 7, 2005.

* cited by examiner

*Primary Examiner*—Mark Paschall
(74) *Attorney, Agent, or Firm*—Michael Best & Friedrich LLP

(57) ABSTRACT

A fluid-heating apparatus for heating a fluid and method of operating the same. The fluid-heating apparatus includes a heating element for heating a fluid surrounding the heating element and a control circuit connected to the heating element and connectable to a power source. The control circuit includes a current path from the power source to the heating element back to the power source, a switch connected in the current path, and a current sensor. The method includes initiating a heating state of the fluid-heating apparatus, initiating a non-heating state of the fluid-heating apparatus, applying a voltage to the heating element during the non-heating state, sensing a leakage current of the heating element during the application of the voltage, and determining a degradation of the heating element with the sensed leakage current.

32 Claims, 4 Drawing Sheets

FLUID-HEATING APPARATUS, CIRCUIT FOR HEATING A FLUID, AND METHOD OF OPERATING THE SAME

BACKGROUND

The invention relates to a fluid-heating apparatus, such as an electric water heater, that can determine a degradation of a heating element of the apparatus, and a method of operating the fluid-heating apparatus.

When an electric-resistance heating element fails in an electric water heater, the operation of the heater is diminished until the element is replaced. This can be an inconvenience to the user of the water heater.

SUMMARY

Failure of the electric-resistance element may not be immediate. For example, the element typically has a sheath isolated from an element wire by an insulator, such as packed magnesium oxide. If the sheath is damaged, the insulator can still insulate the wire and prevent a complete failure of the element. However, the insulator does become hydrated over time and the wire eventually shorts, resulting in failure of the element. The invention, in at least one embodiment, detects the degradation of the heating element due to a damaged sheath prior to failure of the heating element. The warning of the degradation to the element prior to failure of the element allows the user to replace the element with little downtime on his appliance.

A heating element generates heat that can be transferred to water surrounding the heating element. Water can dissipate much of the heat energy produced by the heating element. The temperature of the heating element rises rapidly initially when power is applied and then the rate of temperature rise slows until the temperature of the heating element remains relatively constant. Should power be applied to the heating element prior to the water heater being filled with water or should a malfunction occur in which the water in the water heater is not at a level high enough to surround the heating element, a potential condition known as "dry-fire" exists. Because there is no water surrounding the heating element to dissipate the heat, the heating element can heat up to a temperature that causes the heating element to fail. Failure can occur in a matter of only seconds. Therefore, it is desirable to detect a dry-fire condition quickly, before damage to the heating element occurs.

In one embodiment, the invention provides a method of controlling a fluid-heating apparatus. The fluid-heating apparatus includes a heating element for heating a fluid surrounding the heating element and a control circuit connected to the heating element and connectable to a power source. The control circuit includes a switch connected in a current path from the power source to the heating element back to the power source, and a current sensor. The method includes initiating a heating state of the fluid-heating apparatus by establishing a current in the current path, the establishing act comprising making the switch to allow current in the current path; initiating a non-heating state and ceasing the heating state of the fluid-heating apparatus by ceasing the current in the current path, the ceasing act comprising breaking the switch to not allow current in the current path; applying a voltage to the heating element during the non-heating state; sensing a leakage current of the heating element during the application of the voltage; and determining a degradation of the heating element prior to a failure of the heating element with the sensed leakage current.

In another embodiment, the invention provides a fluid-heating apparatus for heating a fluid. The fluid-heating apparatus includes a vessel, an inlet to introduce the fluid into the vessel, an outlet to remove the fluid from the vessel, a heating element at least partially surrounded by the fluid in the vessel. The heating element includes a wire, an insulating material surrounding at least a portion of the wire, and a sheath surrounding at least a portion of the insulating material. The fluid-heating apparatus further comprises a ground contact in electrical communication with the sheath, and a control circuit connectable to a power source and connected to the heating element. The control circuit includes a current path having a first leg connecting the power source to a first point of the heating element and a second leg connecting the power source to a second point of the heating element, a switch connected in circuit in the first leg, and a current sensor. In one construction, the control circuit is configured to initiate a heating state of the fluid-heating apparatus by establishing a current in the current path, the establishing act including making the switch to allow current in the first current path; initiate a non-heating state and ceasing the heating state of the fluid-heating apparatus by ceasing the current in the current path, the ceasing act including breaking the switch to not allow current in the first current path; connect the power source to the second point of the heating element during the non-heating state thereby allowing a current in the second leg during the non-heating state; sense a leakage current of the heating element during the connection of the power source to the second point of the heating element during the non-heating state; and determine a degradation of the heating element prior to a failure of the heating element with the sensed leakage current.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected," "supported," and "coupled" are used broadly and encompass both direct and indirect mountings, connections, supports, and couplings. Further, "connected" and "coupled" are not restricted to physical or mechanical connections or couplings, and can include electrical connections or couplings, whether direct or indirect.

Figure 1:
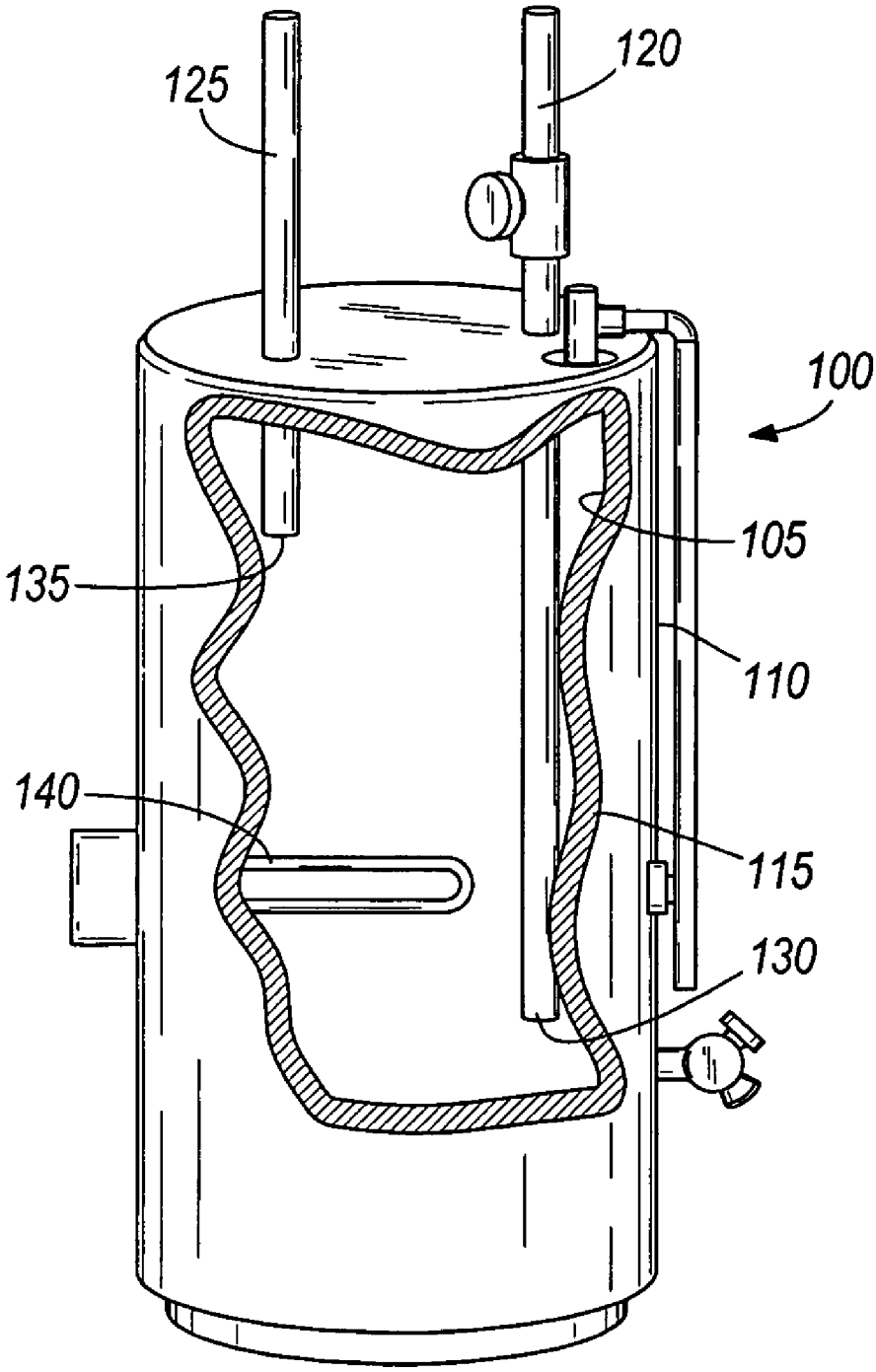
FIG. 1 is a partial exposed view of a water heater embodying the invention.

FIG. 1 illustrates a storage-type water heater 100 including an enclosed water tank 105 (also referred to herein as an enclosed vessel), a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. However, the storage tank 105 can be made of other materials, such as plastic. A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The tank may also include a grounding element (or contact) that is in contact with the water stored in the tank. Alternatively, the grounding element can be part of another component of the water heater, such as the plug of the heating element (discussed below). The grounding element comprises a metal material that allows a current path to ground.

Figure 2:
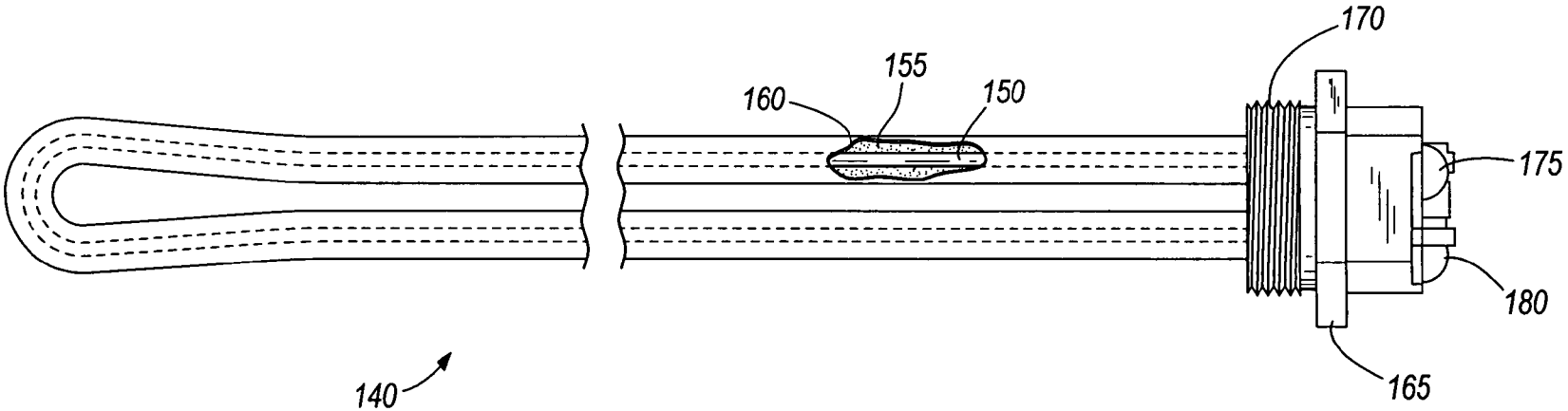
FIG. 2 is a partial exposed, partial side view of an electrode capable of being used in the water heater of FIG. 1.

The water heater 100 also includes an electric resistance heating element 140 that is attached to the tank 105 and extends into the tank 105 to heat the water. An exemplary heating element 140 capable of being used in the water heater 100 is shown in FIG. 2. With reference to FIG. 2, the heating element 140 includes an internal high resistance heating element wire 150, surrounded by a suitable insulating material 155 (such as packed magnesium oxide), a metal jacket (or sheath) 160 enclosing the insulating material, and an element connector assembly 165 (typically referred to as a plug) that couples the metal jacket 160 to the shell 110, which may be grounded. For the construction shown, the connector assembly 165 includes a metal spud 170 having threads, which secure the heating element 140 to the shell 110 by mating with the threads of an opening of the shell 110. The connector assembly 165 also includes connectors 175 and 180 for electrically connecting the wire 150 to the control circuit (discussed below), which provides controlled power to the wire 150. While a water heater 100 having the element 140 is shown, the invention can be used with other fluid-heating apparatus for heating a conductive fluid, such as an instantaneous water heater or an oil heater, and with other heater element designs and arrangements.

Figure 3:
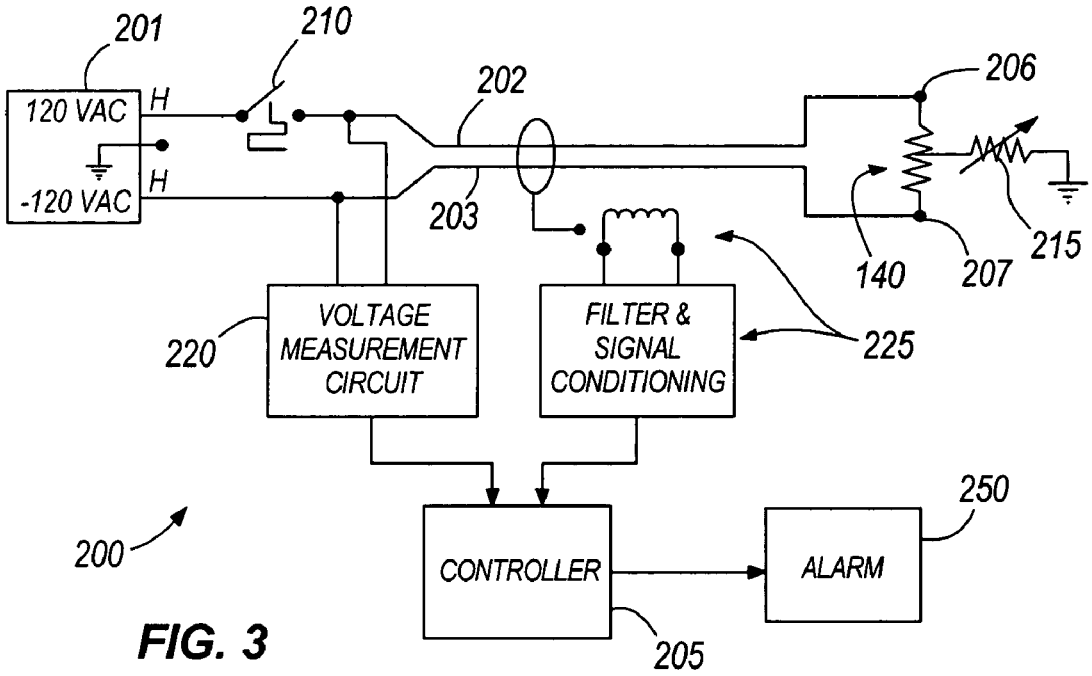
FIG. 3 is a partial block diagram, partial electric schematic of a first control circuit capable of controlling the electrode of FIG. 2.

A partial electrical schematic, partial block diagram for one construction of a control circuit 200 used for controlling the heating element 140 is shown in FIG. 3. The control circuit 200 includes a microcontroller 205. As will be discussed in more detail below, the microcontroller 205 receives signals or inputs from a plurality of sensors or circuits, analyzes the inputs, and generates one or more outputs to control the water heater 100. In one construction, the microcontroller 205 includes a processor and memory. The memory includes one or more modules having instructions. The processor obtains, interprets, and executes the instructions to control the water heater 100. Although the microcontroller 205 is described as having a processor and memory, the invention may be implemented with other controllers or devices including a variety of integrated circuits (e.g., an application-specific-integrated circuit) and discrete devices, as would be apparent to one of ordinary skill in the art. Additionally, the microcontroller 205 and the control circuit 200 can include other circuitry and perform other functions not discussed herein as is known in the art.

Referring again to FIG. 3, the control circuit 200 further includes a current path from a power supply 201 to the heating element 140 back to the power supply 201. The current path includes a first leg 202 and a second leg 203. The first leg 202 connects the power source 201 to a first point 206 of the heating element 140 and the second leg 203 connects the power source 201 to a second point 207 of the heating element 140. A thermostat, which is shown as a switch 210 that opens and closes depending on whether the water needs to be heated, is connected in the first leg 202 between the power source 201 and the heating element 206. When closed, the thermostat switch 210 allows a current from the power source 201 to the heating element 140 and back to the power source 201 via the first and second legs 202 and 203. This results in the heating element 140 heating the water to a desired set point determined by the thermostat. The heating of the water to a desired set point is referred to herein as the water heater 100 being in a heating state. When open, the thermostat switch 210 prevents a current flow from the power source 201 to the heating element 140 and back to the power source 201 via the first and second legs 202 and 203. This results in the water heater 100 being in a non-heating state. Other methods of sensing the water temperature and controlling current to the heating element 140 from the power source 201 are possible (e.g., an electronic control having a sensor, the microcontroller 205 coupled to the sensor to receive a signal having a relation to the sensed temperature, and an electronic switch such as a triac controlled by the microcontroller in response to the sensed temperature).

As just stated, the thermostat switch 210 allows a current through the heating element 140 when the switch 210 is closed. A variable leakage current can flow from the element wire 150 to the sheath 160 via the insulating material 155 when a voltage is applied to the heating element 140. The variable resistor 215 represents the leakage resistance, which allows the leakage path. The resistance between the wire and ground drops from approximately 4,000,000 ohms to approximately 40,000 ohms or less when the heating element 140 degrades due to a failure in the sheath 160. This will be discussed in more detail below.

The control circuit 210 further includes a voltage measurement circuit 220 and a current measurement circuit 225. The voltage measurement circuit 220, which can include a filter and a signal conditioner for filtering and conditioning the sensed voltage to a level suitable for the microcontroller 205, senses a voltage difference between the first and second legs 202 and 203. This voltage difference can be used to determine whether the thermostat switch 210 is open or closed. The current measurement circuit 225 senses a current to the heating element 140 with a toroidal current transformer 230. The toroidal current transformer 235 can be disposed around both legs 202 and 203 to prevent current sense signal overload during the heating state of the water heater 100, and accurately measure leakage current during the non-heating state of the water heater 100. The current measurement circuit 225 can further include a filter and signal conditioner for filtering and conditioning the sensed current value to a level suitable for the microcontroller 205.

During operation of the water heater 100, the sheath 160 may degrade resulting in a breach (referred to herein as the aperture) in the sheath 160. When the aperture exposes the insulating material 155, the material 155 may absorb water. Eventually, the insulating material 155 may saturate, resulting in the wire 150 becoming grounded. This will result in the failure of the element 140.

When the insulating material 155 absorbs water, the material 155 physically changes as it hydrates. The hydrating of the insulating material 155 decreases the resistance 215 of a leakage path from the element wire 150 to the grounded element (e.g., the heating element plug 165 and the coupled sheath 160). The control circuit 200 of the invention recognizes the changing of the resistance 215 of the leakage path, and issues an alarm when the leakage current increases to a predetermined level.

More specific to FIG. 3, it is common in the United States to apply 240 VAC to the element wire 140 by connecting a first 120 VAC to the first leg 202 and a second 120 VAC to the second leg 203. The thermostat switch 210 removes the first 120 VAC from being applied to the heating element 140, thereby having the water heater 100 enter a non-heating state. However, as shown in FIG. 3, the second 120 VAC through the second leg is still applied to the heating element 140. As a consequence, a leakage current can still flow through the leakage resistance 215. The voltage measurement circuit 220 provides a signal to the microcontroller 205 representing, either directly or through analysis by the microcontroller 205, whether the thermostat switch 210 is in an open state, and the current measurement circuit 230 provides a signal to the microcontroller 205 representing, either directly or through analysis by the microcontroller 205, the current through the circuit path including the leakage current. The microcontroller 205 can issue an alarm when the measured leakage current is greater than a threshold indicating the heating element 140 has a degrading sheath 160. The threshold value can be set based on empirical testing for the model of the water heater 100. The alarm can be in the form of a visual and/or audio alarm 250. It is even envisioned that the alarm can be in the form of preventing further heating of the water until the heating element 140 is changed.

In another construction of the water heater 100, the voltage measurement circuit 220 may not be required if the control of the current to the heating element 140 is performed by the microcontroller 205. That is, the voltage measurement circuit 220 can inform the microcontroller 205 when the water heater 100 enters a heating state. However, in some water heaters, the microcontroller 205 receives a temperature of the water in the tank 105 from a temperature sensor and controls the current to the heating element 140 via a relay (i.e., directly controls the state of the water heater 100). For this construction, the voltage measurement circuit 220 is not required since the microcontroller knows the state of the water heater 100.

In yet another construction of the water heater 100, the microcontroller 205 (or some other component) may control the current measurement circuit 225 to sense the current through the heating element 140 only during the "off" state. This construction allows the current measurement circuit 225 to be more sensitive to the leakage current during the non-heating state.

Referring to TABLE 1, the table provides the results of eight tests performed on eight different elements. Each of the elements where similar in shape to the element 140 shown in FIG. 2. The elements were 4500 watt elements secured in 52 gallon electric water heaters similar in design to the water heater 100 shown in FIG. 1. Various measurements of the elements were taken during the tests. The measurements include the "Power 'On' Average Measured Differential Current", the "Power 'On' Maximum Measured Differential Current", the "Power 'Off' Average Measure Differential Current (ma)", and the "Power 'Off' Maximum Measured Differential current." Aperture were introduced to the sheath 160 of elements E, F, G, and H. The apertures resulted in the degradation of the insulating materials 155. Measurements for the elements EFGH were taken while the insulators degraded. The data in TABLE 1 shows that the current measurements of elements with intact sheaths 160 taken during the "on" state (or heating state), overlap with the current measurements of elements with a damaged sheath 160. For example, the element "Edge Hole G", has a lower average current than the good element C and the good element D. In contrast, the current measurements made during the "off" state (or non-heating state) indicate a wide gap in current readings for an element with a damaged sheath 160 versus the element with an intact sheath 160. For example, the lowest average current measured for a degraded sheath 160, Edge Hole G at 12.5 ma, is over six times higher than the highest average current measured for an uncompromised element, i.e., Good D.

TABLE 1

| | DIFFERENTIAL CURRENT MEASUREMENTS | | | |
|---|---|---|---|---|
| ELEMENT | POWER "ON" AVERAGE MEASURED DIFFERENTIAL CURRENT (ma) | POWER "ON" MAXIMUM MEASURED DIFFERENTIAL CURRENT (ma) | POWER "OFF" AVERAGE MEASURED DIFFERENTIAL CURRENT (ma) | POWER "OFF" MAXIMUM MEASURED DIFFERENTIAL CURRENT (ma) |
| Good A | 0.45 | 2.78 | 0.56 | 3.15 |
| Good B | 3.78 | 4.19 | 0.15 | 1.72 |
| Good C | 4.41 | 5.15 | 0.10 | 0.12 |
| Good D | 8.38 | 9.73 | 2.07 | 2.90 |
| Center Hole E | 59.9 | >407 | 218.8 | >407 |
| Center Hole F | 79.8 | >407 | 144.3 | 378 |
| Edge Hole G | 4.38 | 24.5 | 12.5 | 78.2 |
| Edge Hole H | 9.44 | 14.7 | 13.8 | 15.2 |

Figure 4:
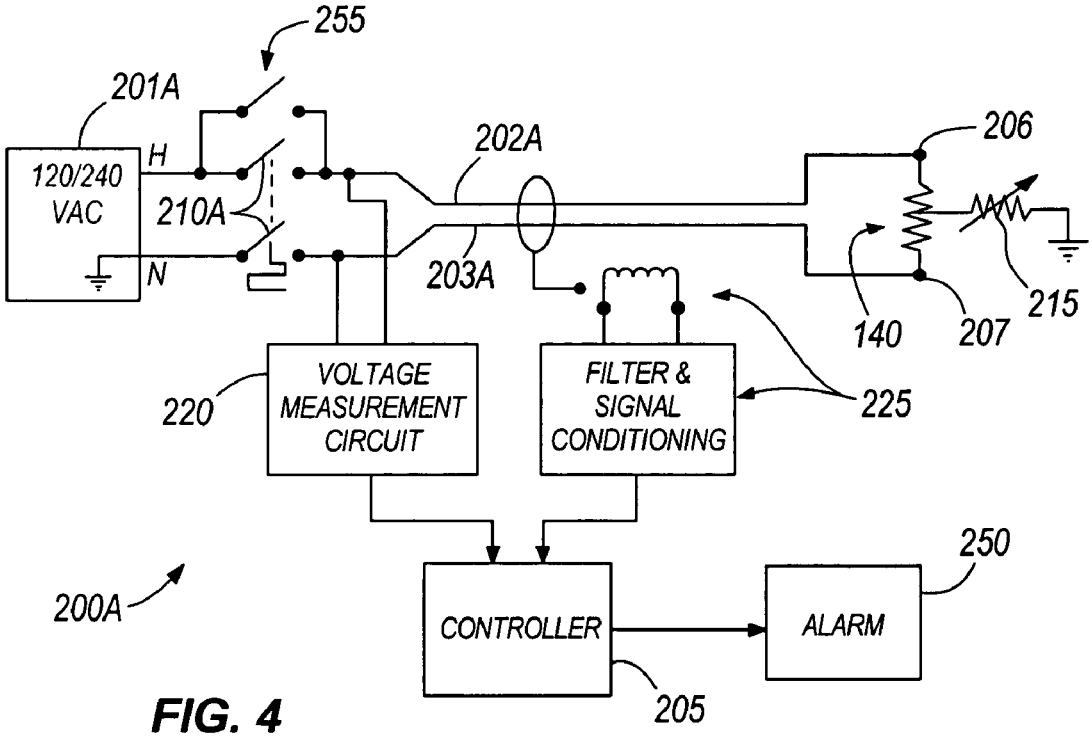
FIG. 4 is a partial block diagram, partial electric schematic of a second control circuit capable of controlling the electrode of FIG. 2.

A partial electrical schematic, partial block diagram for another construction of the control circuit 200A used for controlling the heating element 140 is shown in FIG. 4. Similar to the construction shown in FIG. 3, the control circuit 200A includes the microcontroller 205, the thermostat switch 210A, the voltage measurement circuit 220, and the current measurement circuit 225. However, for the construction of the control circuit in FIG. 4, the first leg 202A of the circuit 200A is connected to 120 VAC or 240 VAC and the second leg 203A of the control circuit 200 is connected to ground. As further shown in FIG. 4, the double pole thermostat switch 210A is electrically connected between the current measurement circuit 225 and 120 VAC or 240 VAC. The operation of the control circuit 200A for FIG. 4 is similar to the control circuit 200 for FIG. 3. TABLE 2 demonstrates a comparison between a heating element 140 initially having no apertures and the element 140 having an aperture at the edge of the element 140. As can be seen, TABLE 2 demonstrates a large difference in current between the degraded element and the good element during the non-heating state.

TABLE 2

DIFFERENTIAL CURRENT MEASUREMENTS DURING POWER "OFF" CONDITION (240 VAC)

| ELEMENT ID | Starting Current (mA) | Current at 1 Hour (mA) |
|---|---|---|
| Good | 0.04 mA | 0.15 mA |
| Center Hole | 560 mA | 693 mA |

Before proceeding further, it should be understood that the constructions described thus far can include additional circuitry to allow for intermittent testing. For example and as shown in FIG. 2, a second switch 255 controlled by the microcontroller 225 can be added to attach the power source 201A to the heating element 140 when thermostat switch 210A is open, allowing the microcontroller 225 to perform a leakage current calculation.

Figure 5:
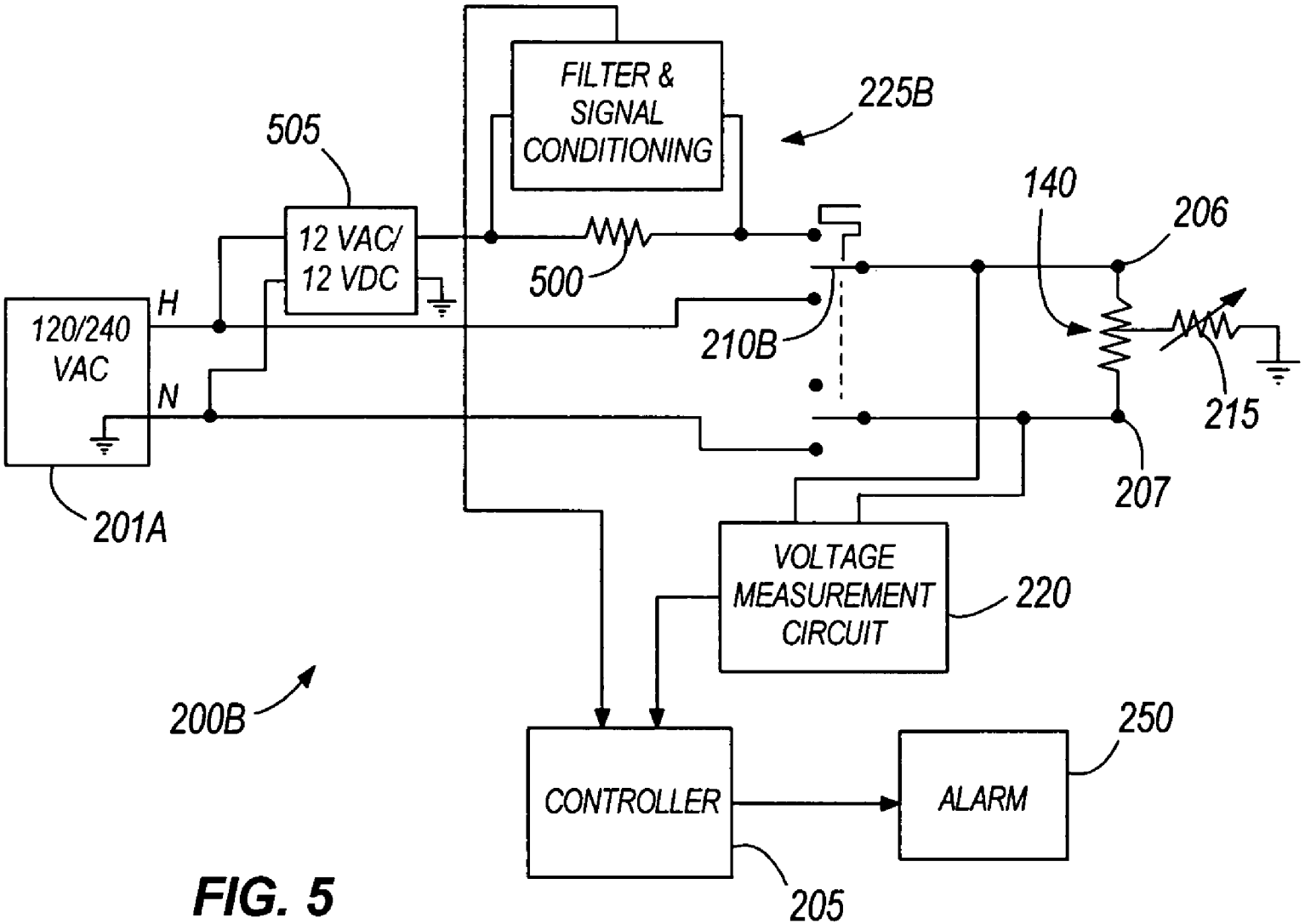
FIG. 5 is a partial block diagram, partial electric schematic of a third control circuit capable of controlling the electrode of FIG. 2.

A partial electrical schematic, partial block diagram for yet another construction of the control circuit 200B used for controlling the heating element 140 is shown in FIG. 5. Similar to the construction shown in FIG. 3, the control circuit 200B includes the microcontroller 205, a thermostat switch 210B, the voltage measurement circuit 220, and a current measurement circuit 225B. However, for the construction of the control circuit 200B in FIG. 5, the arrangement and operation of the circuit 200B shown in FIG. 5 is slightly different than the arrangement of the circuit 200 shown in FIG. 3. As shown in FIG. 5, the current measurement circuit 225B includes a current resistive shunt 500 that is electrically connected between a 12 VDC (or 12 VAC) power supply 505 and the thermostat switch 210B. The thermostat switch 210B is controlled by the thermostat temperature sensor and switches between the 120 VAC (or 240 VAC) power source and the 12 VDC (or 12 VAC) power supply 505. The voltage measurement circuit 220 is electrically connected in parallel with the heating element to determine the state of the water heater 100. The operation of the control circuit 200B for FIG. 5 is somewhat similar to the control circuit 200 for FIG. 3. However, unlike the control circuit 200 for FIG. 3, when the control circuit 200B moves to the non-heating state, the thermostat switch 210B applies the voltage of the low-voltage power supply 505 to the heating element 140. TABLE 3 demonstrates a comparison between a heating element 140 initially having no apertures and the element 140 having an aperture at the edge of the element 140. As can be seen, TABLE 3 demonstrates a large difference in current between the degraded element and the good element during the non-heating state.

TABLE 3

DIFFERENTIAL CURRENT MEASUREMENTS DURING POWER "OFF" CONDITION (12 VDC)

| ELEMENT ID | Starting Current (mA) | Current at 1 Hour (mA) |
|---|---|---|
| Good | 0.0 mA | 0.0 mA |
| Center Hole | 18 mA | 18 mA |

Thus, the invention provides, among other things, a new and useful water heater and method of controlling a water heater. Various features and advantages of the invention are set forth in the following claims.

What is claimed is:

1. A method of controlling a fluid-heating apparatus, the fluid-heating apparatus comprising a heating element for heating a fluid surrounding the heating element and a control circuit connected to the heating element and connectable to a power source, the control circuit comprising a current path from the power source to the heating element back to the power source, a switch connected in the current path, and a current sensor, the method comprising:

initiating a heating state of the fluid-heating apparatus by establishing a current in the current path, the establishing act comprising making the switch to allow current in the current path;

initiating a non-heating state and ceasing the heating state of the fluid-heating apparatus by ceasing the current in the current path, the ceasing act comprising breaking the switch to not allow current in the current path;

applying a voltage to the heating element during the non-heating state;

sensing a leakage current of the heating element during the application of the voltage; and determining a degradation of the heating element prior to a failure of the heating element with the sensed leakage current.

2. A method as set forth in claim 1 wherein the control circuit further comprises a second switch connected in the current path.

3. A method as set forth in claim 1 wherein the fluid-heating apparatus is a storage-type water heater, and the element is an electric-resistance heating element.

4. A method as set forth in claim 1 wherein the storage-type water heater comprises a tank, wherein the heating element comprises a connector assembly that secures the heating element to the tank, and wherein the connector assembly comprises a ground contact.

5. A method as set forth in claim 1 wherein the current path comprises a first leg connecting the power source to a first point of the heating element and a second leg connecting the power source to a second point of the heating element, wherein the switch is connected in circuit in the first and second legs, wherein applying a voltage to the heating element comprises applying the power source to the first point of the heating element thereby allowing a current in the first leg, and wherein sensing a leakage current comprises sensing a current in the second leg.

6. A method as set forth in claim 1 wherein the current path comprises a first leg connecting the power source to a first point of the heating element and a second leg connecting the power source to a second point of the heating element, wherein the switch is connected in circuit in the first leg, wherein applying a voltage comprises making the switch to a low-voltage power supply thereby allowing a current in a second current path from the low-voltage power supply to the first point of the heating element, and wherein sensing a leakage current comprises sensing a current in the second current path.

7. A method as set forth in claim 6 wherein the sensor is connected in circuit in the second current path.

8. A method as set forth in claim 1 wherein the method further comprises issuing an alarm when the determination indicates a degradation of the heating element.

9. A method as set forth in claim 1 wherein applying a voltage comprises intermittently applying a voltage to the heating element.

10. A method as set forth in claim 5 wherein the switch comprises a thermostat switch.

11. A method as set forth in claim 10 wherein the control circuit further comprises a voltage measurement circuit connected to the first leg and the second leg, wherein the voltage measurement circuit is connected to the first leg between the thermostat switch and the heating element, and wherein the method further comprises sensing a voltage with the voltage measurement circuit and determining the state of the fluid-heating apparatus based on the sensed voltage.

12. A method as set forth in claim 1 wherein the current sensor comprises a current transformer.

13. A method as set forth in claim 1 wherein the control circuit further comprises a microcontroller, and wherein the switch comprises a relay responsive to the microcontroller.

14. A method as set forth in claim 1 wherein the method further comprises determining a value representative of the leakage current, and wherein the determining act comprises determining whether the value is greater than a threshold indicative of the degradation.

15. A fluid-heating apparatus for heating a fluid, the fluid-heating apparatus being connectable to a power source, the fluid-heating apparatus comprising:

a vessel;

an inlet to introduce the fluid into the vessel;

an outlet to remove the fluid from the vessel;

a heating element at least partially surrounded by the fluid in the vessel, the heating element comprising a wire, an insulating material surrounding at least a portion of the wire, and a sheath surrounding at least a portion of the insulating material;

a ground contact in electrical communication with the sheath;

a control circuit connectable to the power source and connected to the heating element, the control circuit comprising a current path having a first leg connecting the power source to a first point of the heating element and a second leg connecting the power source to a second point of the heating element, a switch connected in circuit in the first leg, and a current sensor connected to the current path, the control circuit being configured to initiate a heating state of the fluid-heating apparatus by establishing a current in the current path, the establishing act comprising making the switch to allow current in the first current path, initiate a non-heating state and ceasing the heating state of the fluid-heating apparatus by ceasing the current in the current path, the ceasing act comprising breaking the switch to not allow current in the first current path, allow connection of the power source to the second point of the heating element during the non-heating state thereby allowing a current in the second leg during the non-heating state, sense a leakage current of the heating element during the connection of the power source to the second point of the heating element during the non-heating state; and determine a degradation of the heating element prior to a failure of the heating element with the sensed leakage current.

16. A fluid-heating apparatus as set forth in claim 15 wherein the fluid-heating apparatus is a storage-type water heater, wherein the vessel comprises a storage tank, and wherein the heating element is supported by the storage tank.

17. A fluid-heating apparatus as set forth in claim 16 wherein the heating element comprises a connector assembly that secures the heating element to the tank, and wherein the connector assembly comprises the ground contact.

18. A fluid-heating apparatus as set forth in claim 15 wherein the ground contact is in electrical communication with the sheath via the fluid.

19. A fluid-heating apparatus as set forth in claim 15 wherein the control circuit comprises a second switch connected in circuit of the second leg, wherein the control circuit is further configured to allow connection of the power source to the second point of the heating element thereby allowing a current in the second leg during the non-heating state by intermittently making the second switch.

20. A fluid-heating apparatus as set forth in claim 15 wherein the current sensor comprises a toroidal transformer sensing a current of the first and second legs.

21. A fluid-heating apparatus as set forth in claim 15 wherein the control circuit further comprises a speaker and wherein the control circuit is further configured to issue an alarm when the determination indicates a degradation of the heating element.

22. A fluid-heating apparatus as set forth in claim 15 wherein the switch comprises a thermostat switch.

23. A fluid-heating apparatus as set forth in claim 22 wherein the control circuit further comprises a voltage measurement circuit connected to the first leg and the second leg, wherein the voltage measurement circuit is connected to the first leg between the thermostat switch and the heating element, and wherein the control circuit is further configured to sense a voltage with the voltage measurement circuit and determine the state of the fluid-heating apparatus based on the sensed voltage.

24. A fluid-heating apparatus as set forth in claim 15 wherein the control circuit further comprises a microcontroller, and wherein the switch comprises a relay responsive to the microcontroller.

25. A fluid-heating apparatus for heating a fluid, the fluid-heating apparatus being electrically connectable to a power source, the fluid-heating apparatus comprising:

a vessel;

an inlet to introduce the fluid into the vessel;

an outlet to remove the fluid from the vessel;

a heating element at least partially surrounded by the fluid in the vessel, the heating element comprising a wire, an insulating material surrounding at least a portion of the wire, and a sheath surrounding at least a portion of the insulating material;

a ground contact in electrical communication with the sheath;

a control circuit connectable to the power source and connected to the heating element, the control circuit comprising a first current path having a first leg connecting the power source to a first point of the heating element and a second leg connecting the power source to a second point of the heating element, a switch connected in circuit in the first leg, a second current path connecting a low-voltage power supply to the heating element via the switch, and a current sensor connected to the second current path, the control circuit being configured to initiate a heating state of the fluid-heating apparatus by establishing a current in the first current path, the establishing act comprising making the switch to allow current in the first current path, initiate a non-heating state and ceasing the heating state of the fluid-heating apparatus by ceasing the current in the current path, connect the low-voltage power supply to the heating element during the non-heating state thereby allowing a current in the second current path during the non-heating state, sense a leakage current of the heating element during the connection of the low-voltage power supply to the heating element; and determine a degradation of the heating element prior to a failure of the heating element with the sensed leakage current.

26. A fluid-heating apparatus as set forth in claim 25 wherein the current sensor is connected in circuit in the second current path.

27. A fluid-heating apparatus as set forth in claim 25 wherein the fluid-heating apparatus is a storage-type water heater, wherein the vessel comprises a storage tank, and wherein the heating element is supported by the storage tank.

28. A fluid-heating apparatus as set forth in claim 27 wherein the heating element comprises a connector assembly that secures the heating element to the tank, and wherein the connector assembly comprises the ground contact.

29. A fluid-heating apparatus as set forth in claim 25 wherein the ground contact is in electrical communication with the sheath via the fluid.

30. A fluid-heating apparatus as set forth in claim 25 wherein the control circuit further comprises a speaker and wherein the control circuit is further configured to issue an alarm when the determination indicates a degradation of the heating element.

31. A fluid-heating apparatus as set forth in claim 25 wherein the switch comprises a thermostat switch.

32. A fluid-heating apparatus as set forth in claim 25 wherein the control circuit further comprises a microcontroller, and wherein the switch comprises a relay responsive to the microcontroller.

* * * * *